US009862565B2

(12) United States Patent
Karlsson et al.

(10) Patent No.: US 9,862,565 B2
(45) Date of Patent: Jan. 9, 2018

(54) METHOD FOR REMOVAL OF MATERIAL RESIDUES FROM ROLLS WITH A MATERIAL CARRYING CORE

(71) Applicant: Core Link AB, Falkenberg (SE)

(72) Inventors: Jan Karlsson, Falkenberg (SE); Peter Mårtensson, Glommen (SE); Nils Strandh, Gullbrandstorp (SE)

(73) Assignee: CORE LINK AB, Falkenberg (SE)

( * ) Notice: Subject to any disclaimer, the term of this patent is extended or adjusted under 35 U.S.C. 154(b) by 65 days.

(21) Appl. No.: 14/411,294

(22) PCT Filed: Jun. 24, 2013

(86) PCT No.: PCT/SE2013/050758

§ 371 (c)(1),
(2) Date: Dec. 24, 2014

(87) PCT Pub. No.: WO2014/007725

PCT Pub. Date: Jan. 9, 2014

(65) Prior Publication Data

US 2015/0344264 A1 Dec. 3, 2015

(30) Foreign Application Priority Data

Jul. 3, 2012 (SE) ..... 1200407

(51) Int. Cl.

| | |
|---|---|
| ***B65H 73/00*** | (2006.01) |
| ***B26D 1/18*** | (2006.01) |
| ***B26D 3/00*** | (2006.01) |

(52) U.S. Cl.

CPC ..... *B65H 73/00* (2013.01); *B26D 1/18* (2013.01); *B26D 3/001* (2013.01); *B65H 2301/415525* (2013.01); *Y10T 83/0281* (2015.04)

(58) Field of Classification Search

CPC .. Y10T 83/896; Y10T 83/6667; Y10S 83/924; B65H 73/00; B65H 2301/415525; B26D 1/18; B26D 3/001

See application file for complete search history.

(56) References Cited

U.S. PATENT DOCUMENTS 4,779,498 A * 10/1988 Perkins ..... B26D 1/0006 83/175

4,864,906 A 9/1989 Hall (Continued)

FOREIGN PATENT DOCUMENTS

| | | |
|---|---|---|
| EP | 2439162 A2 | 4/2012 |
| SE | 519378 C2 | 2/2003 |
| SE | 533080 C2 | 6/2010 |

OTHER PUBLICATIONS

International Search Report (ISR) (PCT Form PCT/ISA/210), in PCT/SE2013/050758, dated Oct. 10, 2013.

*Primary Examiner* — Phong Nguyen

(74) *Attorney, Agent, or Firm* — McGinn IP Law Group, LLC.

(57) ABSTRACT

The present invention concerns a method for removal of material residues, particularly tissue or similar porous, non-self-supporting materials, from a material-carrying core, which often has relatively large dimensions, e.g. a diameter of approx. 300 mm and a length of approx. 2540 mm, and thereby allow re-use of the core in the same way as new and unused cores a number of times for winding non-self-supporting or porous material, particularly tissue, wherein a cut section is made in the envelope surface of the roll having the material-carrying core from one end or end portion of the roll to the other end or end portion of the roll by means of a driven rotary knife, which is connected to a motor for rotation of the same.

10 Claims, 5 Drawing Sheets

(56) References Cited

U.S. PATENT DOCUMENTS

| | | | | |
|---|---|---|---|---|
| 5,243,890 | A * | 9/1993 | Ober | B26D 1/205 83/471.2 |
| 5,367,930 | A | 11/1994 | Lemley | |
| 6,761,098 | B1 * | 7/2004 | Esping | B26D 3/001 83/102 |
| 8,196,501 | B2 * | 6/2012 | Bilskie | B26D 1/18 83/649 |

* cited by examiner

METHOD FOR REMOVAL OF MATERIAL RESIDUES FROM ROLLS WITH A MATERIAL CARRYING CORE

The present invention concerns a method according to the preamble of claim 1.

Particularly in the tissue industry, large cores are used having an inner diameter of, for instance, 250 to 600 mm and having large lengths. For economical reasons, and not the least environmental reasons, it is a large advantage if such large cores can be re-used as many times as possible. For this purpose, it is necessary to remove the material residues from a roll for the exposure of the material-carrying core and this has hitherto been done in a manual way by means of knives and other tools. This often leads to damage to the extraordinarily sensitive envelope material, which damage makes re-use of the cores impossible. Attempts at mechanical cleaning, which means cutting down of porous materials or non-self-supporting materials, e.g. tissue, and the like by means of so-called roll cutters of conventional type, often lead to problems with the capacity. There arise so-called "confetti" and problem of getting rid of cut-off material from the roll, i.e., the core with the material, because of the surfaces not being smooth, and therefore the cut away material has a tendency to stay on the subjacent material not yet cut-off. The capacity problem depends largely on the fact that, in a conventional roll cutter, it is not possible to make a deep cut section, but the material is pulled and torn away. Said material, the so-called "confetti", whirls on one hand around in the air and on the other hand falls down on the floor at the ends of the roll and gives rise to disturbances to sensors, etc., as well as leads to worse working environment around the equipment. Thus, there is a large need of a method to eliminate said complex of problems.

The object of providing such a method that meets the above-mentioned need forms the basis of the present invention.

This object is realised by the present invention in the method mentioned by way of introduction by it being given the characteristic features of claim 1.

By, according to the present invention, rotating the knife by means of a motor, no tearing up or away of materials occurs and the section surface or cut section will become more or less free from loose material. The motor-driven rotary knife allows considerably greater depth of the cut section than previously. The depth of the cut section can be increased to several centimeters from, as previously, a few millimeters. By the method according to the present invention, the amount of loose material is reduced to almost nothing at all.

Furthermore, the capacity is increased by the greater cut section depth and by the material falling off the roll easily by rotation of the roll in different directions after the cut section. This means large savings both from an economic and an environmental point of view.

In the following, the present invention will be described in more detail, reference being made to the appended drawings.

Figure 1:
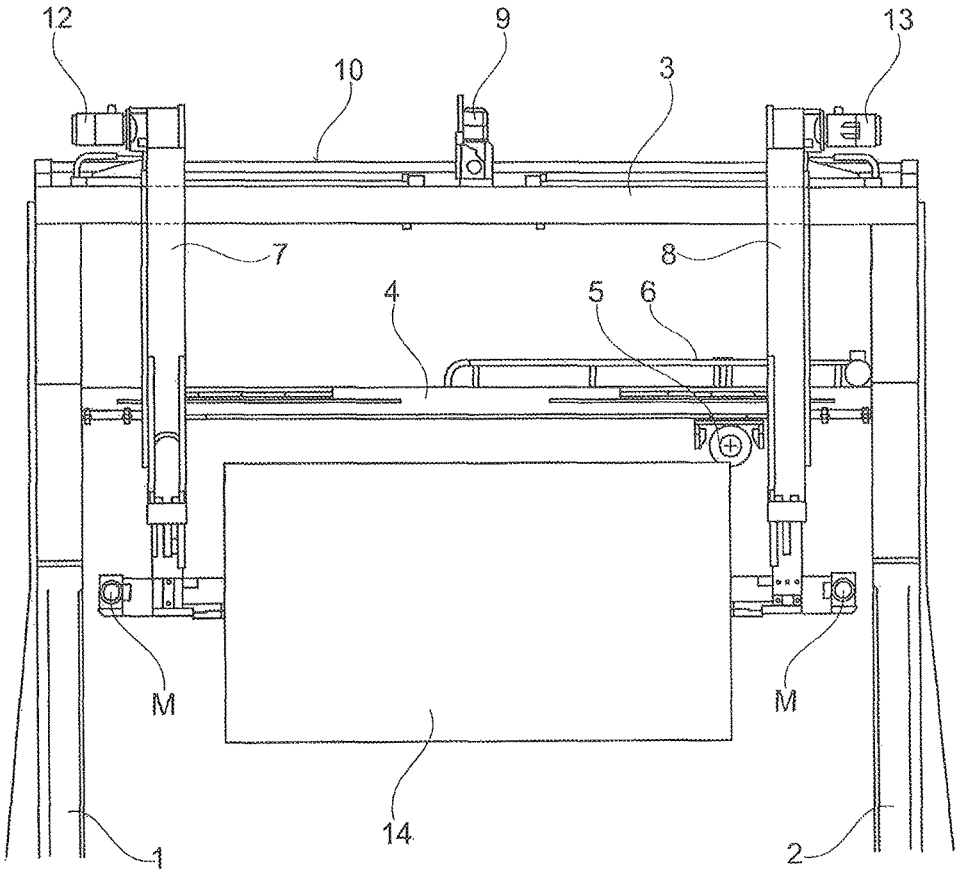
FIG. 1 shows a view from the front of a device for carrying out the method according to the present invention.
Figure 2:
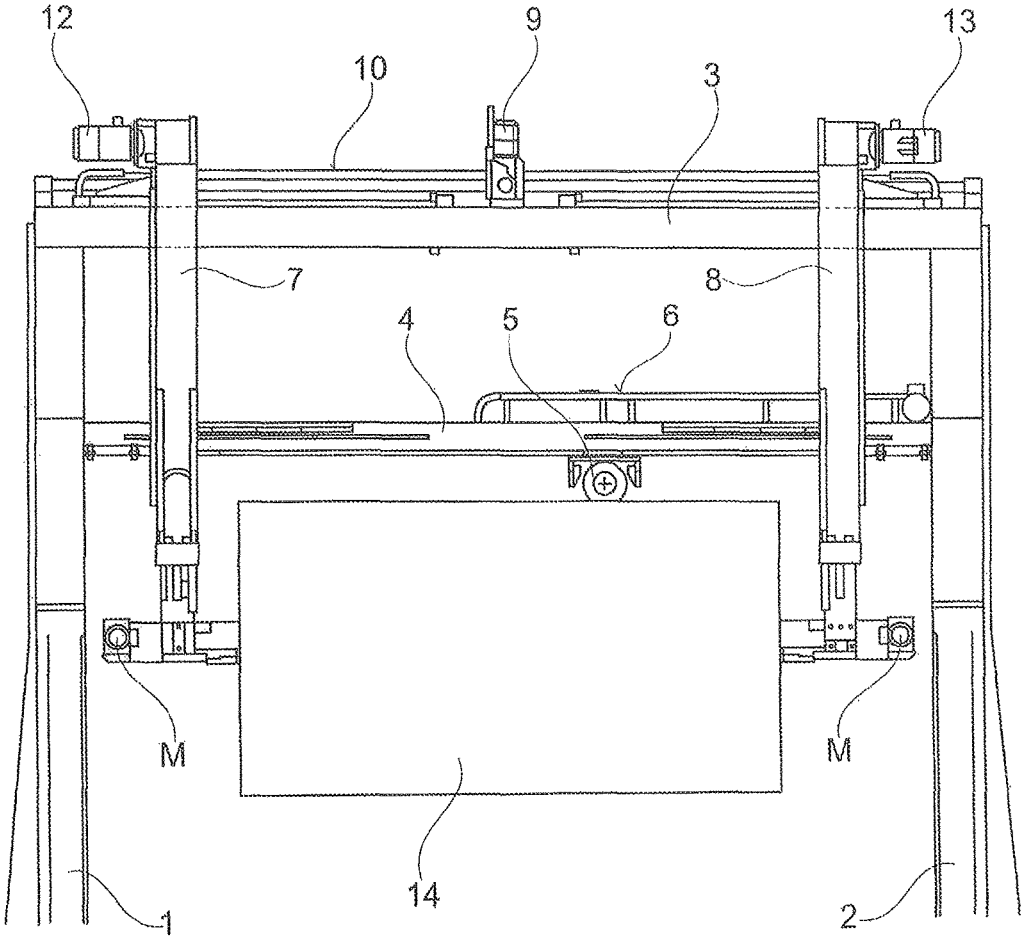
FIG. 2 shows a similar view as FIG. 1 with parts in another position.
Figure 3:
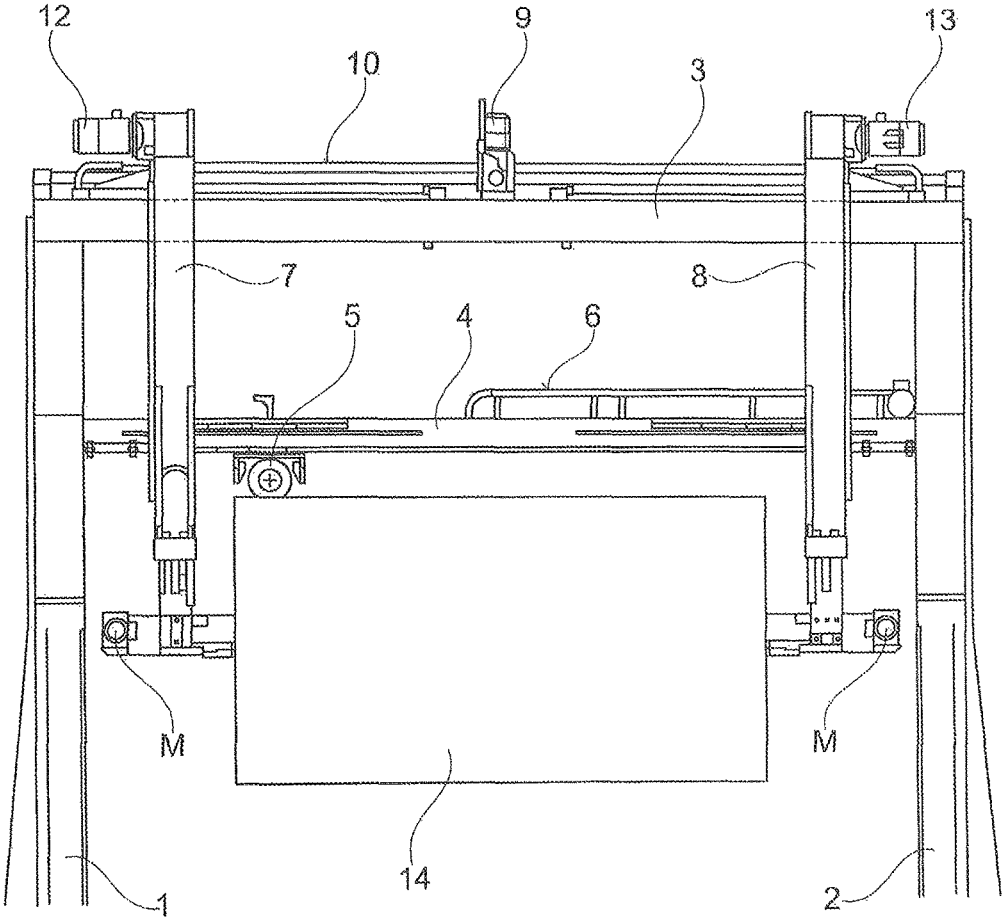
FIG. 3 shows a similar view as FIGS. 1 and 2 with parts in an additional position.

In the following, an embodiment of a method according to the present invention will be described as well as a device for executing the same. The device shown in FIGS. 1-3 is in the form of a portal having legs 1 and 2 as well as a beam 3 resting on the legs. The legs 1 and 2 rest on each side of a working surface, e.g. platform or a table (not shown). The legs 1 and 2 may be fixed but also movable along the working surface. A tool-carrying beam 4 extends between the legs 1 and 2 under the beam 3. The tool-carrying beam 4 may be fixed or movable up and down along the legs 1 and 2. The beam 4 supports a driven rotary knife 5. The driven rotary knife 5 is movable to and fro on the beam 4 between the legs 1 and 2 by means of a driving arrangement 6. From the beam 3, two pairs of vertical arms 7 and 8 extend, one of the pairs of vertical arms 7 being arranged near the leg 1 and the other pair of vertical arms 8 being arranged at the leg 2. The arms 7 and 8 are movable to and from the legs 1 by means of a motor 9 and tooth belts 10, or the like.

Figure 4:
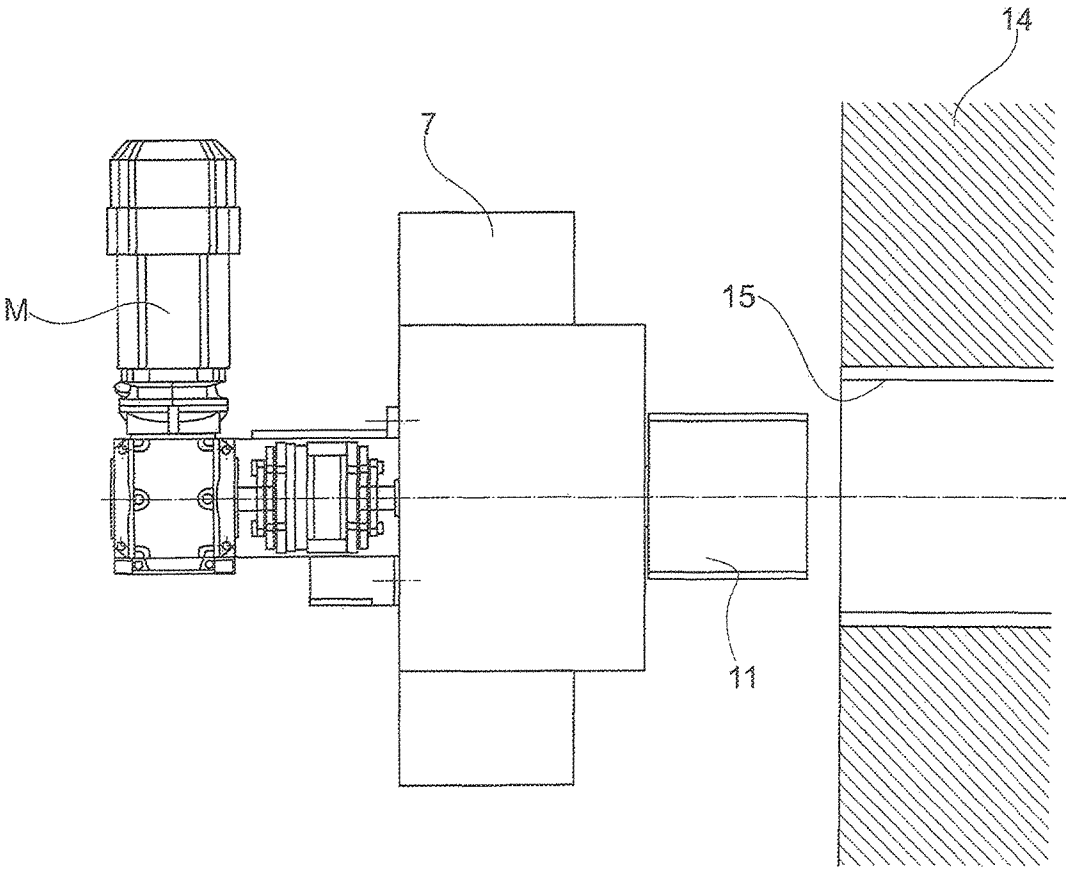
FIG. 4 shows a view from above of a part of the device in FIGS. 1-3 with a part of the roll composed of core and material sectioned along the centre line.

The part of the device shown in FIG. 4 for carrying out the method according to the present invention is provided with a rotary chuck 11 mounted on the lower end of the arms 7 and 8. The part according to FIG. 4 having the rotary chuck 11 is liftable and lowerable by means of a motor 12 on one arm pair 7 and a motor 13 on the other arm pair 8. The arms of each of the leg pairs 7 and 8 extend parallel to each other and on each side of the beam 4, which supports the driven rotary knife 5. The space between the arm pairs 7 and 8 and the end or end portion of the roll 14 allows handling of rolls 14, on which the material primarily in the outer turns has slid beyond the end or end portion of the roll 14. This can be made in gripper handling of the roll in vertical position. The gripper handling of the roll may cause the central part of the roll 14 to be displaced downward because of small friction between the material turns, so that the material projects up over the end portion or end of the roll 14 and results in a funnel-like shape. The rotary chuck 11 may possibly be longer or be displaceable into and out of the core 15.

A roll 14 consists of a core 15 and a material of paper or the like, e.g. tissue, which also is denominated non-self-supporting material. As mentioned by way of introduction, the method according to the present invention is utilized to remove material residues from the core 15 for re-use of the core 15. The roll 14 is lifted by means of the arms 7 and 8 to the working position shown in FIGS. 1-3 after the rotary chucks 11 have been moved into the ends of the core 15 by moving the arms 7 and 8 toward the ends of the roll 14, which is placed on the working surface or platform, and/or only the rotary chuck 11 and its carrying parts. The working position can be reached by moving the roll 14 to the driven rotary knife 5 and/or the beam 4, so that the roll 14 and the knife 5 meet in the working position. The diameter of the rotary chuck 11 is smaller than the diameter of the core 15 so that the risk of damage to the core end is minimized. In FIGS. 1-3, it is seen that the cut section in the material of the roll 14 is relatively deep, e.g. several millimeters and even several centimeters. A several centimeters deep cut section is possible thanks to the present invention, which in an effective way facilitates the removal of the cut material from the roll 14. The rotary chuck 1 is rotatable by means of a motor M via a suitable driving arrangement.

The knife 5 shown in FIGS. 1-3 is suitably rotated by a servomotor via a planetary bevel gear. On each side of the knife 5 driven into rotation, a plough and a blow-off nozzle may be arranged.

Figures 5A, 5B, 5C, 5D:
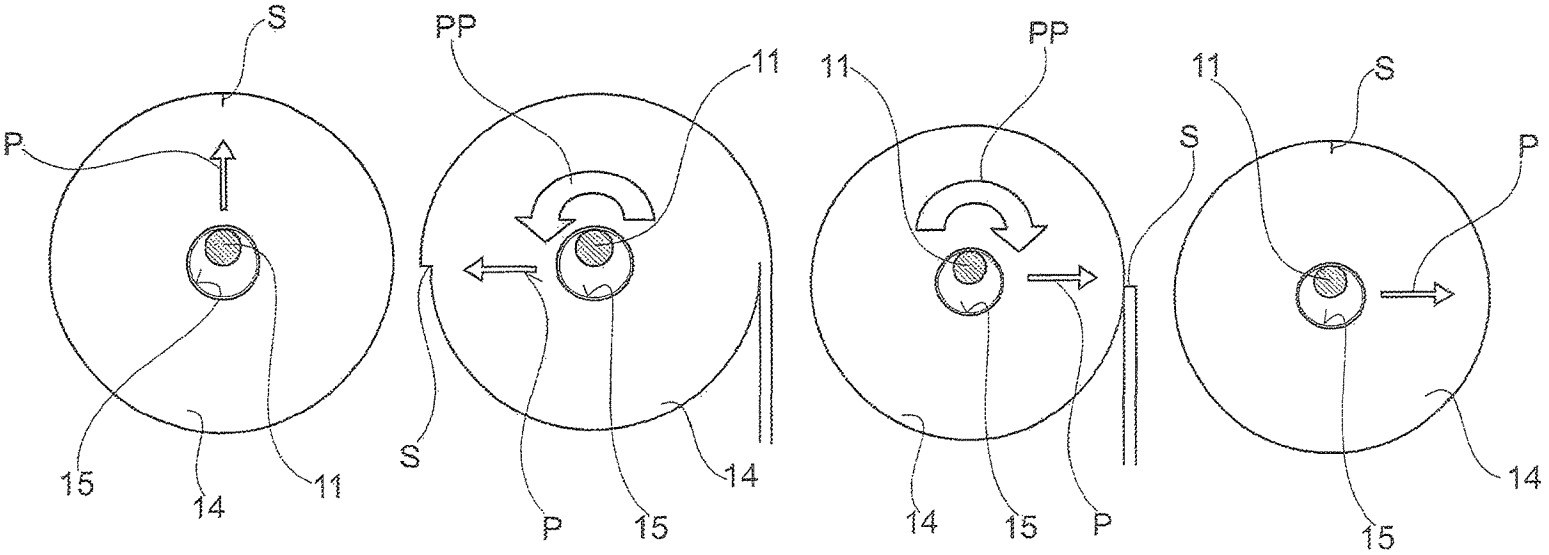
FIGS. 5A-5D show a number of side views of a roll having material residues on a core for the illustration of different stages of an embodiment of a method according to the present invention.

The method according to the present invention is illustrated in FIGS. 5A-5D. The roll 14 is suspended in the rotary chuck 11 and the arrow P is directed toward a cut section S, which has been provided by means of the driven rotary knife 5 in FIGS. 1-3. When the driven rotary knife 5 has reached a position outside the end portion of the roll 14, the roll 14 is rotated counter-clockwise in the direction of the arrow PP to the position shown in FIG. 5B 90-135° from the position in FIG. 5A, or until the material intersected by the cut section S releases from the material remaining on the roll and is hanging principally vertically downward. From this position, with the cut section S approximately at 7, 8 or 9 o'clock, the roll 14 is rotated clockwise according to the arrow PP in FIG. 5C until the cut section S is right in front of the arrow P or approaches said position, or until the material intersected by the cut section S releases and falls down under the roll 14, where it is easy to take care of and remove for suitable further handling. With the roll 14 in this position, which is shown in FIG. 5D, a new cut section S is made approximately at 12 o'clock, whereupon the roll 14 is rotated counter-clockwise until the new cut section S is in the position shown in FIG. 5B, after which the procedure is repeated, until the desired amount of material has been removed from the roll 14. The core 15 may now be restored as desired for re-use in the process.

Numerous modifications of the embodiments according to the present invention described above are naturally possible within the scope of the general idea of the invention defined in the subsequent claims.

The invention claimed is:

1. A method for removal of material residues, from a roll having a material-carrying core having dimensions including a diameter of approximately 300 mm and a length of approximately 2540 mm to thereby allow re-use of the core in a same way as new and unused cores a number of times for winding the material residues, the method comprising:

providing:

a beam;

a leg connected to one end of the beam;

a vertical arm that extends from the beam towards the roll, the vertical arm being moveable to and from the leg; and a driven chuck disposed at an end of the vertical arm that fits into the core for rotating the roll;

making a cut section in an envelope surface of the roll having the material-carrying core from one end or end portion of the roll to an other end or end portion of the roll by the driven rotary knife;

performing a first rotation of the roll, via the driven chuck, with the cut section in one direction so that the material residues intersected by the cut section release from the material residues remaining on the roll into a position hanging vertically downward;

after the material residues release, performing a second rotation of the roll, via the driven chuck, in an opposite direction to the one direction so that a rest of the material residues intersected by the cut section releases from the material remaining on the roll; and if required, repeating the first rotation and the second rotation until a desired amount of the material residues has been removed, wherein the driven rotary knife is connected to a motor for reciprocating of the knife, and wherein the roll with the cut section is rotated at least 90° in the one direction, until the cut section is tangent to or ends up on the underside of the roll, and, after the material residues release, the roll with the cut section is rotated at least 180° or more in the opposite direction for releasing the rest of the material residues intersected by the cut section, so that the same falls down under the roll having the material-carrying core.

2. A method according to claim 1, wherein the roll with the cut section is rotated more than 90° in the one direction.

3. A method according to claim 2, wherein the roll with the cut section is rotated 135° in the one direction.

4. A method according to claim 1, wherein a new cut section is made using the driven rotary knife with the roll in said 180° position after the material residues intersected by the cut section has released and fallen down under the roll having the material-carrying core.

5. A method according to claim 1, wherein the driven rotary knife is rotated down into the material residues on the roll under movement of the knife from one end or end portion to the other end or end portion, and the rotation of the knife is reversed under movement of the same from the other end or end portion back to said one end or end portion.

6. The method according to claim 1, wherein the material residues comprise one of:

a tissue material; and a porous, non-self-supporting material.

7. The method according to claim 1, wherein, when the driven rotary knife reaches a position outside an end portion of the roll, the roll is rotated in the opposite direction.

8. A method for removal of material residues, from a roll having a material-carrying core having dimensions including a diameter of approximately 300 mm and a length of approximately 2540 mm to thereby allow re-use of the core in a same way as new and unused cores a number of times for winding the material residues, the method comprising:

providing:

a beam;

a leg connected to one end of the beam;

a vertical arm that extends from the beam towards the roll, the vertical arm being moveable to and from the leg; and a driven chuck disposed at an end of the vertical arm that fits into the core for rotating the roll;

making a cut section in an envelope surface of the roll having the material-carrying core from one end or end portion of the roll to an other end or end portion of the roll by the driven rotary knife;

performing a first rotation of the roll, via the driven chuck, with the cut section in one direction, so that the material residues intersected by the cut section release from the material residues remaining on the roll into a position hanging vertically downward; and after the material residues release, performing a second rotation of the roll, via the driven chuck, in an opposite direction to the one direction so that a rest of the material residues intersected by the cut section releases from the material remaining on the roll, wherein the roll with the cut section is rotated at least 90° in the one direction, until the cut section is tangent to or ends up on the underside of the roll, and, after the material residues release, the roll with the cut section is rotated at least 180° or more in the opposite direction for releasing the rest of the material residues intersected by the cut section, so that the same falls down under the roll having the material-carrying core.

9. The method according to claim 8, further comprising repeating the first rotation and the second rotation until a desired amount of the material residues has been removed.

10. The method according to claim 8, wherein the driven rotary knife is connected to a motor for reciprocating of the knife.

* * * * *